US010187933B2

(12) United States Patent
Liu et al.

(10) Patent No.: US 10,187,933 B2
(45) Date of Patent: Jan. 22, 2019

(54) MICROWAVE OVEN AND CONTROL METHOD THEREOF

(71) Applicant: Xiaomi Inc., Beijing (CN)

(72) Inventors: Dongxu Liu, Beijing (CN); Yi Wu, Beijing (CN); Nuo Yang, Beijing (CN)

(73) Assignee: Xiaomi Inc., Beijing (CN)

( * ) Notice: Subject to any disclaimer, the term of this patent is extended or adjusted under 35 U.S.C. 154(b) by 238 days.

(21) Appl. No.: 15/240,426

(22) Filed: Aug. 18, 2016

(65) Prior Publication Data

US 2017/0064778 A1 Mar. 2, 2017

(30) Foreign Application Priority Data

Aug. 31, 2015 (CN) ..... 2015 1 0549604

(51) Int. Cl.
*H05B 6/66* (2006.01)
*H05B 6/64* (2006.01)

(52) U.S. Cl.
CPC ..... *H05B 6/6447* (2013.01); *H05B 6/666* (2013.01); *H05B 6/668* (2013.01)

(58) Field of Classification Search
CPC .. H05B 6/6417; H05B 6/6447; H05B 6/6488; H05B 6/645; H05B 6/6455; H05B 6/6485; H05B 6/666; H05B 6/668; H05B 6/68
USPC ..... 219/702, 704, 705, 714, 715, 716, 720, 219/725, 736, 756, 762
See application file for complete search history.

(56) References Cited

U.S. PATENT DOCUMENTS

2003/0215354 A1 11/2003 Clark et al.
2005/0236408 A1* 10/2005 Schulte ..... H05B 6/6417 219/737
2007/0278220 A1 12/2007 Bostick et al.
2014/0251987 A1 9/2014 Reay
2015/0289324 A1* 10/2015 Rober ..... H05B 6/68 219/702
2016/0192446 A1* 6/2016 Seddik ..... H05B 6/6441 219/705

FOREIGN PATENT DOCUMENTS

CN 1904483 A 1/2007
CN 2916427 Y 6/2007
CN 103822276 A 5/2014
CN 204329088 U 5/2015
(Continued)

OTHER PUBLICATIONS

English Translation of International Search Report dated Sep. 7, 2016 for International Application No. PCT/CN2016/084785, 2 pages.

(Continued)

*Primary Examiner* — Hung D Nguyen
(74) *Attorney, Agent, or Firm* — Brinks, Gilson & Lione

(57) ABSTRACT

A system and method for safe operation of a microwave oven is disclosed. The heating function of the microwave oven may be automatically disabled upon detection, by the microwave oven, of a metal object entering a heating compartment of the microwave. The detection may be based on magnetic induction. Further, the heating function of the microwave may be automatically enabled and recovered upon detection, by the microwave oven, of a metal object being removed from the heating compartment of the microwave.

13 Claims, 8 Drawing Sheets

(56) References Cited

FOREIGN PATENT DOCUMENTS

| | | | | |
|---|---|---|---|---|
| CN | 105091049 | A | 11/2015 | |
| CN | 105157072 | A | 12/2015 | |
| EP | 2 418 916 | A1 | 2/2012 | |
| EP | 2418916 | A1 * | 2/2012 | ..... H05B 6/6447 |
| KR | 10-2012-0015090 | A | 2/2012 | |
| RU | 2 493 959 | C2 | 9/2013 | |

OTHER PUBLICATIONS

Office Action dated Feb. 23, 2017 for Chinese Application No. 201510549604.6, 13 pages.
Office Action dated Feb. 6, 2018 for Russian Application No. 2016141407/07, 10 pages.
Extended European Search Report dated Dec. 22, 2016 for European Application No. 16185345.2, 7 pages.
International Search Report and Written Opinion dated Sep. 7, 2016 for International Application No. PCT/CN2016/084785, 19 pages.
Office Action dated Dec. 9, 2016 for Russian Application No. 2016141407/20, 4 pages.

* cited by examiner

MICROWAVE OVEN AND CONTROL METHOD THEREOF

CROSS-REFERENCE TO RELATED APPLICATIONS

This application claims priority to Chinese Patent Application No. 201510549604.6 filed on Aug. 31, 2015, the entire contents of which are incorporated herein by reference.

TECHNICAL FIELD

The disclosure generally relates to the field of smart home and smart devices, and more particularly, to a smart microwave oven.

BACKGROUND

A microwave oven is a kitchen appliance used to heat food through microwaves. Similar kitchen appliance further includes optical oven.

Metal objects, folded and irregular foils in particular, may be dangerous for a microwave oven, because metal may reflect microwaves inside the microwave oven and generate sparks that may ignite food and components of the microwave oven. In the related art, a warning label is placed on a microwave oven to prompt a user not to place metal contains or objects in the microwave oven. However, since this warning mechanism relies on consciousness of users, accidents may still happen when children or aged users unaware of the danger make use microwave oven without supervision.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, microwave oven is disclosed. The microwave oven includes a case body comprising a heating compartment; a master control board disposed in the case body; and a magnetic field generation component and a magnetic field induction component disposed in the heating compartment, wherein the magnetic field induction component is electrically connected to the master control board.

In another embodiment, a control method for operating a microwave oven is disclosed. The method includes detecting, by a magnetic field induction component disposed at an entrance of a heating compartment of the microwave oven, a first induction signal due to a first change of a magnetic field generated by a magnetic field generation component disposed at the entrance of the heating compartment of the microwave oven; determining, by a master control board electrically connected to the magnetic field induction component, whether a metal object has entered or is entering the heating compartment according to the first induction signal; and disabling, by the master control board, a heating function of the heating compartment in response to determining that a metal object has entered or is entering the heating compartment.

BRIEF DESCRIPTION OF THE DRAWINGS

The accompanying drawings, which are incorporated in and constitute a part of this specification, illustrate embodiments consistent with the disclosure and, together with the description, serve to explain the principles of the disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the disclosure. Instead, they are merely examples of apparatuses and methods consistent with aspects related to the disclosure as recited in the appended claims.

The terminology used in the description of the disclosure herein is for the purpose of describing particular examples only and is not intended to be limiting of the disclosure. As used in the description of the disclosure and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items.

It shall be appreciated that although the present disclosure uses terminologies "first", "second", and "third" and the like to describe various information, the information shall not be limited by these terminologies. Using these terminologies is only for distinguishing information of the same type. For example, without departing from the scope of the present disclosure, the first information may be referred to as the second information, and similarly, the second information may be referred to as the first information. Depending on the context, the terminology "if" used herein may be interpreted as "when" or "in response to determining."

Figure 1:
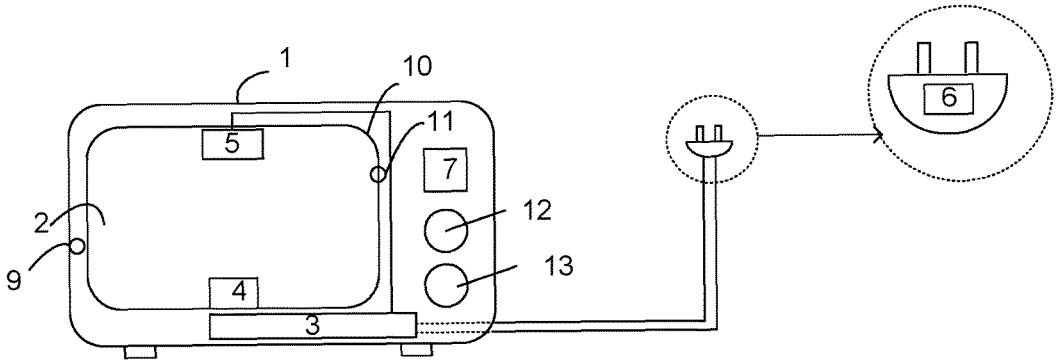
FIG. 1 is a schematic diagram of a microwave oven.

FIG. 1 is a block diagram of an oven according to an exemplary embodiment. In this embodiment, the oven may include a heating function based on microwaves. It may alternatively be an optical oven with a heating function based on light-wave (such as infrared light). It may be other appliances integrated with a microwave of light-wave heating function. In the embodiments of this disclosure, a microwave oven is used as an example.

As shown in FIG. 1, the microwave oven includes: a case body 1, which includes a heating compartment 2; a master control board 3 disposed in the case body 1, the master control board 3 being an electronic component configured to control all parts of the microwave oven for normal functioning; a magnetic field generation component 4 and a magnetic field induction component 5 disposed in the heating compartment 2, wherein when the magnetic field generated by the magnetic field generation component 4 at the magnetic field induction component 5 is modified, the magnetic field induction component 5 can detect the change of the magnetic field. The magnetic field induction component 5 may be electrically connected with the master control board 3.

The microwave oven may further include a magnetron 9 installed within the case body 1 for generating microwaves and emit microwaves into the heating compartment 2. The magnetron may be electrically connected to the master control board 3. The master control board may be configured to control the operation of the magnetron and can, e.g., start, stop, enable, and disable the generation of microwaves by the magnetron.

In one implementation, the magnetic field generation component 4 is disposed at an entrance of the heating compartment 2.

In one implementation, the magnetic field generation component 4 may be a permanent magnet or alternatively be a magnetic coil connected with the master control board 3. For example, the magnetic field generation component 4 may be a permanent magnet, which can generate a magnetic field. When a metal object enters the heating compartment 2, the metal object may cut the magnetic induction lines of the magnetic field generated by the magnetic field generation component 4, thereby changing the magnetic field. The magnetic field generation component 4 may alternatively be a magnetic coil connected with the master control board 3. A current inside the coil will generate a magnetic field around the coil. When a metal object enters the heating compartment 2, it may cut the magnetic induction lines of the coil, thereby changing the magnetic field.

In one implementation, the magnetic field induction component 5 may also be disposed at the entrance of the heating compartment 2. For example, the magnetic field generation component 4 may be disposed at a lower side of the entrance of the heating compartment 2, while the magnetic field induction component 5 may be disposed at an upper side of the entrance of the heating compartment 2. The position of the magnetic field induction component 5 and the magnetic field generation component 4 may be reversed. Alternatively, the magnetic field generation component 4 may be disposed at the right (or left) side of the entrance of the heating compartment 2 whereas the magnetic field induction component 5 may be disposed at left (or right) side of the entrance of the heating compartment 2.

Because the magnetic field induction component 5 is disposed at the entrance of the heating compartment 2, when a metal object pass through the entrance and cut the magnetic induction lines of the magnetic field generation component 4, the magnetic field induction component 5 will detect a induction signal due to the change of magnetic field at the magnetic field induction component 5.

For example, the magnetic field induction component 5 may be a magneto sensor, such as a magnetic-resistive sensor. In one implementation, the magnetic field induction component 5 may be a single magnetic sensor. In some other implementation, the magnetic field induction component may include multiple magnetic sensors. The multiple magnetic sensors of the magnetic field induction components 5 may be arranged in any pattern. They may be arranged in regularly or irregularly patterns.

Generally, when the magnetic field induction component 5 includes one magnetic sensor, it may detect whether a metal object has entered or is entering the heating compartment of the microwave oven. When the magnetic field induction components 5 includes multiple magnetic sensors, the master control board 3 may derive the shape and size of the metal object according to a set of induction signals detected by the multiple magnetic sensors of the magnetic field induction component 5.

When the magnetic field induction component 5 is a magneto-resistive sensor, the magneto-resistive sensor may be configured to detect a change of signal induced by change of the magnetic field at the magneto-resistive sensor of the magnetic field generated by the magnetic field generation component 4. The induced signal change indicates the speed (speed direction and speed magnitude) of the metal object. The magnetic field induction component 5 sends the induced signal to the master control board 3. The master control board 3 is configured to determine whether a metal object has entered or is entering the heating compartment 2 according to the induced signal, and to disable the heating function of the heating compartment 2 when it determines that a metal object has entered or is entering the heating compartment 2. For example, when a metal object enters the heating compartment 2 and is detected by the magnetic field induction element 5, the master control board 3 would be configured to be irresponsive to a heating instruction from a user by, e.g., pressing a button on a control panel of the microwave oven.

The microwave oven may further include a radio communication component 6 electrically connected with the master control board 3, wherein the radio communication component 6 may be installed anywhere in the microwave oven. For example, the radio communication component 8 may be installed in an electric plug of the power source line of the microwave oven. The radio communication component 6 may include at least one of a Wi-Fi network component, Bluetooth component, and zigbee component. The radio communication component 6 may be configured to communicate with other electronic devices external to the microwave oven, such as a mobile phone, a tablet, a smart wearable device, and a laptop computer.

In some embodiment, the microwave oven further includes a display screen 7 in communication with the master control board 3. The display screen 7 may be configured to display an alarm prompt or message under the control of the master control board 3 when the magnetic field induction component 5 detects a signal induced by metal object entering the heating compartment 2. The alarm prompt or message may provide alert to a user so that the user may remove the metal object from the heating compartment of the microwave oven to operate the microwave oven in a safer manner.

The functioning of the magnetic field generation component 4 and the magnetic field induction component 5 may be enabled by the master control board only when a door of the microwave oven 10 to the entrance of the heating compartment is open. A door sensor known in the art such as the element 11 of FIG. 1 may be used for monitoring whether the door 10 is open. The door sensor 11 may be electronically connected to the master control board 3 such that its status can be monitored by the master control board. Thus, the master control board may be configured to determine whether a metal object is entering the heating compartment only when it determines that the door 11 is open.

The microwave of FIG. 1 may further include a control panel 12 for a user to input operation instructions. The control panel may include buttons for the user to start or stop heating. It may also include buttons for the user to set duration of heating. The control panel may be electrically connected to the master control board 3.

Thus, the microwave oven provided in various embodiments of this disclosure includes a case body which includes a heating compartment, a master control board disposed in the case body, a magnetic field generation component and a magnetic field induction component disposed in the heating compartment, wherein the magnetic field induction component is electrically connected with the master control board. The disclosed embodiments thus enhance safety in using microwave ovens by allowing for detecting a signal induced by a metal object entering into the heating compartment and preventing the heating compartment from functioning.

Figure 2:
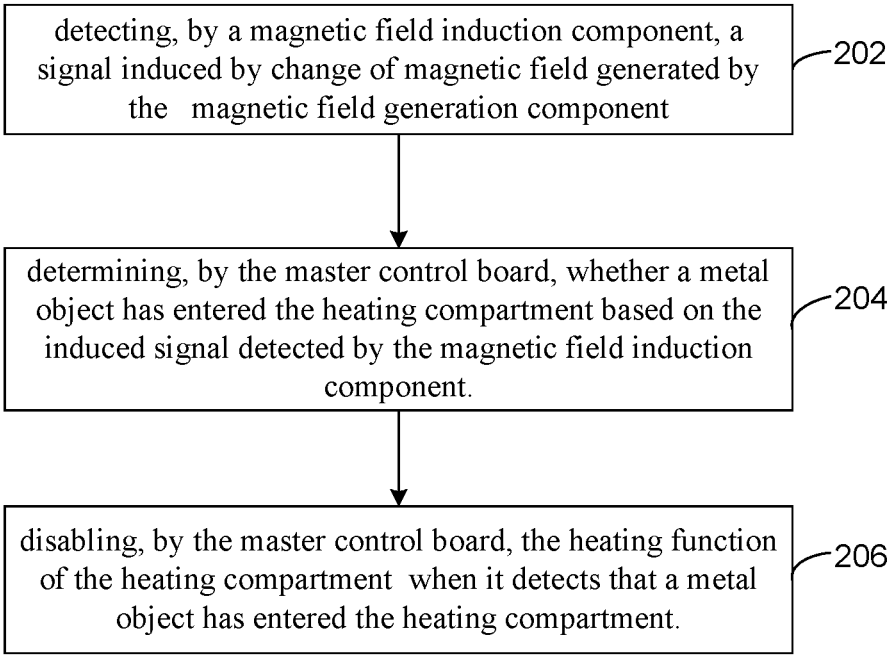
FIG. 2 is a flow chart of a safe operation method for a microwave oven.

FIG. 2 is a flow chart for controlling the operation of a microwave oven according to an exemplary embodiment. This embodiment of FIG. 2 is applied to the exemplary microwave oven shown in FIG. 1.

In Step 202, the magnetic field induction component of the microwave oven detects a signal induced due to change of the magnetic field generated by the magnetic field generation component.

In Step 204, the master control board of the microwave oven determines whether a metal object has entered or is entering the heating compartment based on the induced signal detected by the magnetic field induction component.

In Step 206, the master control board disables the heating function of the heating compartment when it determines that a metal object has entered or is entering the heating compartment. For example, when the master control board determines that a metal object has entered or is entering the heating compartment, the master control board is configured to be irresponsive to an operation instruction input by a user via the control panel 12 of the microwave oven. In a specific implementation, the master control board is electrically connected to the microwave magnetron which may emit microwaves into the heating compartment of microwave oven under the control of the master control board. Thus, disabling the heating function of the microwave oven may be implemented as disabling the magnetron from emitting microwaves.

When the metal object is later removed from the heating compartment, since a movement direction of the metal object at this time is likely to be opposite to a direction of the movement when the metal object enters the heating compartment, the magnetic field induction component such as a magneto-resistive sensor may detect a signal of opposite sign to the signal detected when the metal object enters the microwave. The signals may be opposite in sign because the directions of the change of the magnetic field generated by the magnetic field generation component are opposite. Thus, the master control board can determine whether the metal object is entering to exiting the heating compartment based on the sign of the induced signal in the magnetic field induction component.

Figure 3:
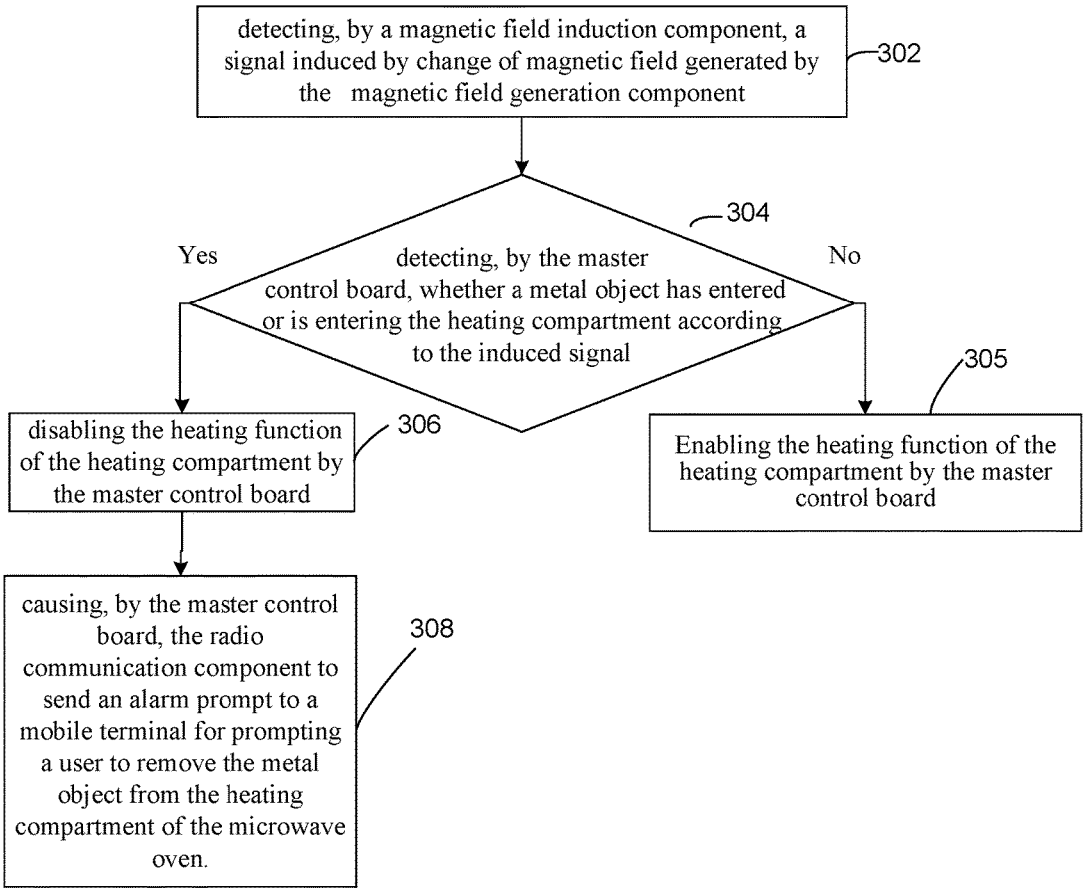
FIG. 3 is a flow chart of another safe operation method for a microwave oven.

FIG. 3 is a flow chart for controlling the operation of a microwave oven according to another exemplary embodiment and as applied to the microwave oven shown in FIG. 1.

In Step 302, the magnetic field induction component of the microwave detects a signal induced due to a change in the magnetic field generated by a magnetic field generation component. Specifically, the magnetic field generation component generates a magnetic field in the heating compartment of the microwave oven. When a metal object enters the heating compartment, the metal object will cut magnetic induction lines, thereby changing the magnetic field sensed by the magnetic field induction component. Then, the magnetic field induction component detects a change in the magnetic field generated by the magnetic field generation component and produces an induction or induced signal.

In Step 304, the master control board determines whether a metal object has entered or is entering a heating compartment based on the signal detected by the magnetic field induction component. Specifically, the magnetic field induction component, such as a magneto-resistive sensor, sends the detected signal induced by a change of magnetic field to the master control board. The master control board then analyzes the received signal from the magnetic field induction component to determine whether a metal object has entered or is entering the heating compartment. For example, signal from the magnetic field induction component may increase or decrease gradually and the master control board may determine that a metal object is entering the heating compartment whereas when no change of the signal from the magnetic field induction component is detected, the master control board may determine that no metal object is entering the heating compartment. In some alternative implementation, signal from the magnetic field induction component may only be generated when there is a change in the magnetic field and thus the master control board may determine that a metal object is entering the heating compartment as soon as signal from the magnetic field induction component is received, rather than having to detect change in a base signal.

In Step 305, the master control board enables the heating function of the heating compartment when it determines that no metal object has entered or is entering the heating compartment. Herein, "enabling" the heating function of the heating compartment of the microwave does not mean turning on the magnetron and begin heating. Rather, it only means that the heating function will not be prohibited by the master control board such that the microwave oven may function when a user instruction to start heating is received.

In Step 306, the master control board may disable the heating function of the heating compartment when it determines that a metal object has entered or is entering the heating compartment. For example, when the master control board determines that a metal object has entered or is entering the heating compartment, the master control board may be configured to be irresponsive to an input operation instruction to turn on the microwave by a user. The master control board, for example, may cache the operation instruction input by the user without executing the instruction until later. For example, it may delay the execution of the instruction until it later determines that the metal object is removed from the heating compartment (described in more detail below) and the door of the microwave is closed.

Figure 4:
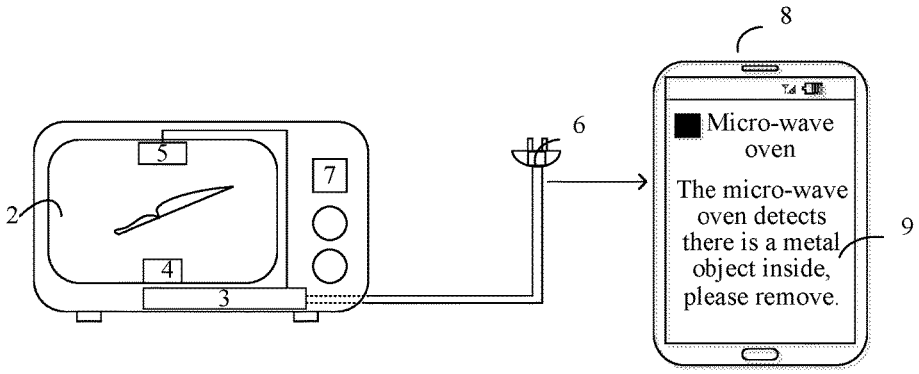
FIG. 4 is a schematic diagram for a microwave in communication with a mobile terminal device.

In Step 308, if the master control board determines that a metal object has entered or is entering the heating compartment, the master control board may cause the radio communication component (6 of FIG. 1) to send an alarm prompt to a mobile terminal for prompting a user to remove the metal object from the heating compartment of the microwave oven. This is shown in FIG. 4. The master control board 3 may cause the radio communication component 6 to send via wireless communication channels (such as Wi-Fi, Bluetooth, and Zigbee channels) the alarm prompt 9 to an application in the mobile terminal 8, to prompt the user to remove the metal object from the heating compartment of the microwave oven.

Figure 5:
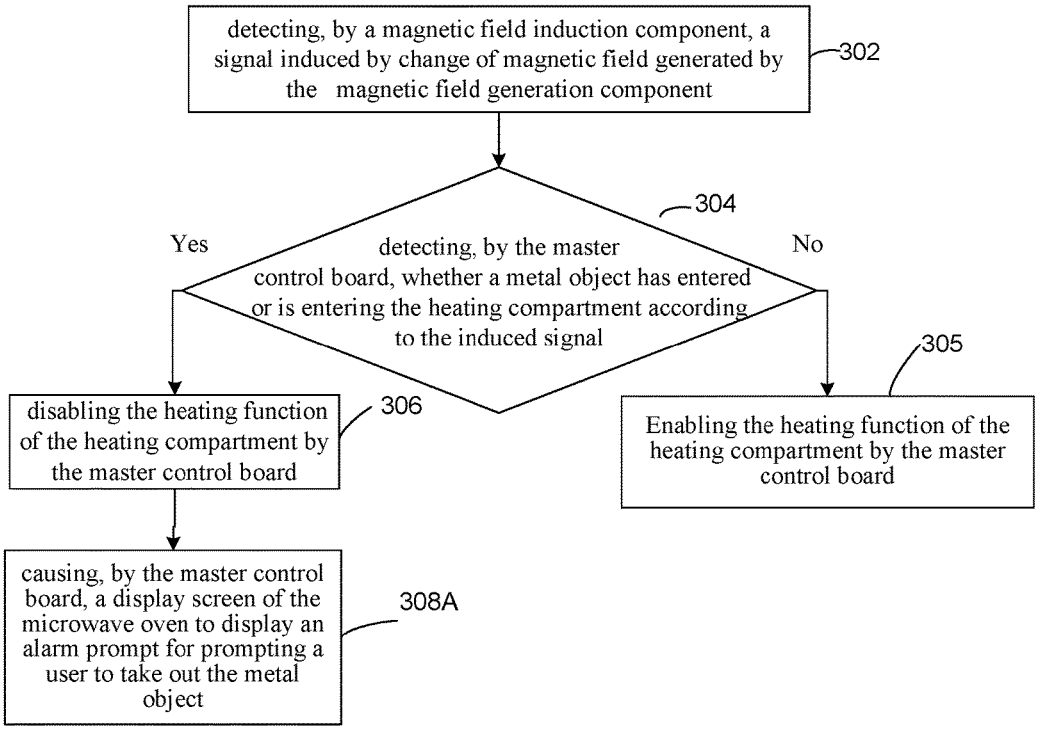
FIG. 5 is a flow chart of another safe operation method for a microwave oven.
Figure 6:
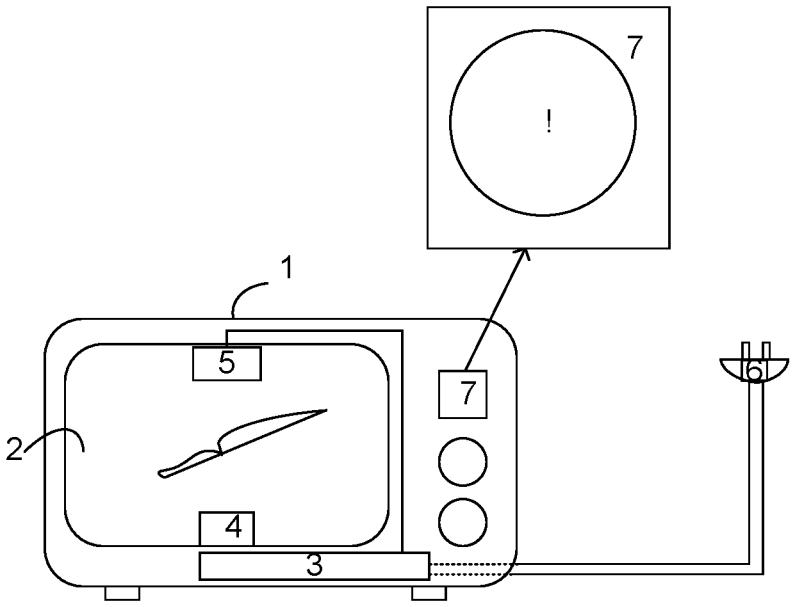
FIG. 6 is a schematic diagram a microwave oven.

In another implementation, as shown in FIG. 5, Step 308 may be implemented as Step 308A. In Step 308A, when the master control board determines that a metal object has entered or is entering the heating compartment, the master control board may cause a display screen of the microwave oven to display an alarm prompt for prompting a user to remove the metal object from the heating compartment of the microwave oven. The alarm prompt may be a text or other symbols that may be regarded as an alert. Alternatively, the user may be promoted to remove the metal object through other visual or audio alerts, such as a flashing light from an indicator, a buzz from a buzzer, or voice prompt. An exemplary alarm prompt displayed on the display screen 7 of the microwave oven is as shown in FIG. 6.

Figure 7:
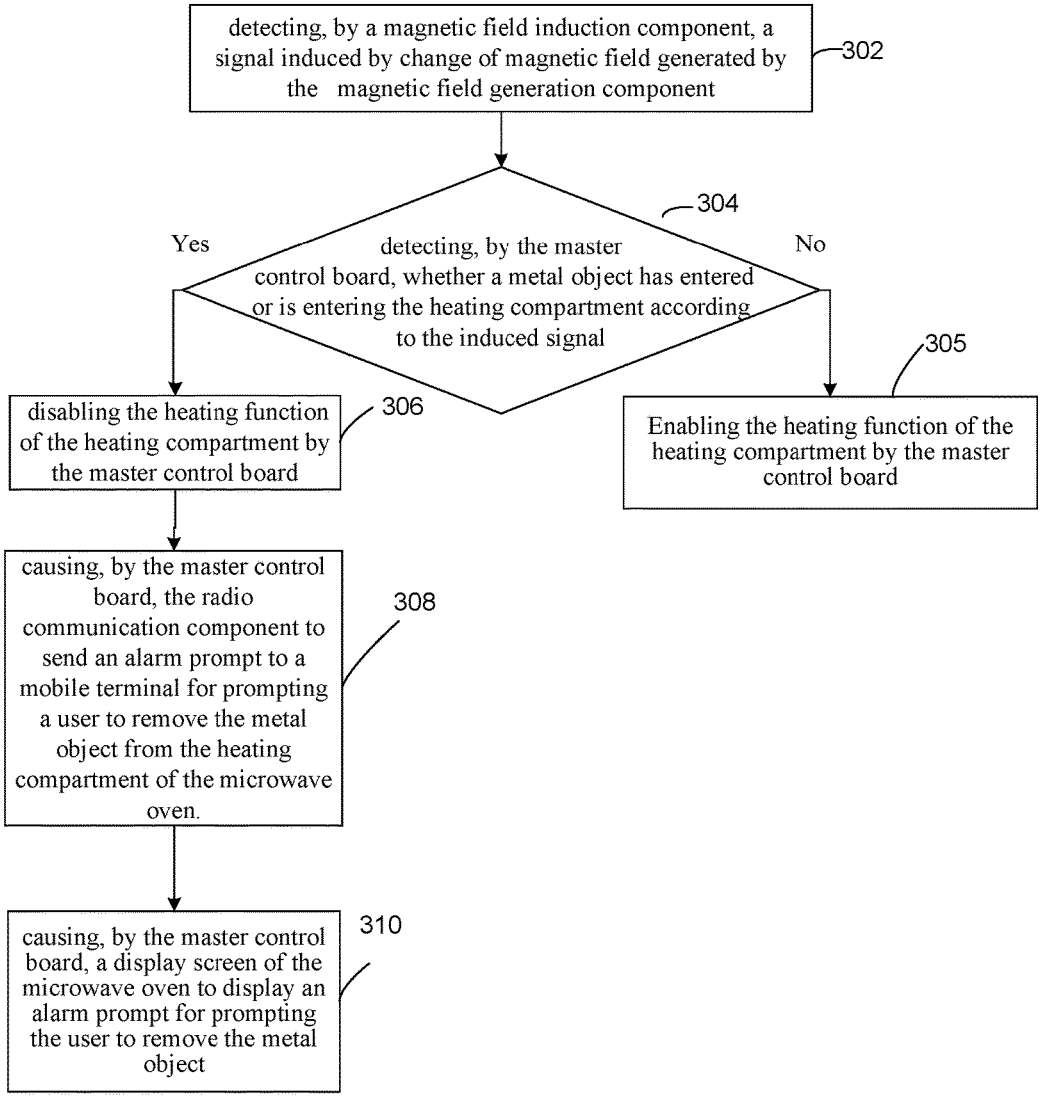
FIG. 7 is a flow chart of another safe operation method for a microwave oven.

As shown in FIG. 7, the method of FIG. 3 may further include the Step 310. In addition to sending alarm prompt to a mobile terminal, in Step 310, if the master control board determines that a metal object has entered or is entering the heating compartment, the master control board also causes the display screen of the microwave oven to display an alarm prompt for prompting the user to remove the metal object. Thus, if the master control board determines that a metal object has entered or is entering the heating compartment, the master control board is configured to cause both the radio communication component to send a first alarm prompt to the mobile terminal and the display screen of the microwave oven to display a second alarm prompt. The content and appearance of the first and second alarm prompts may be identical or may be different.

Figure 8:
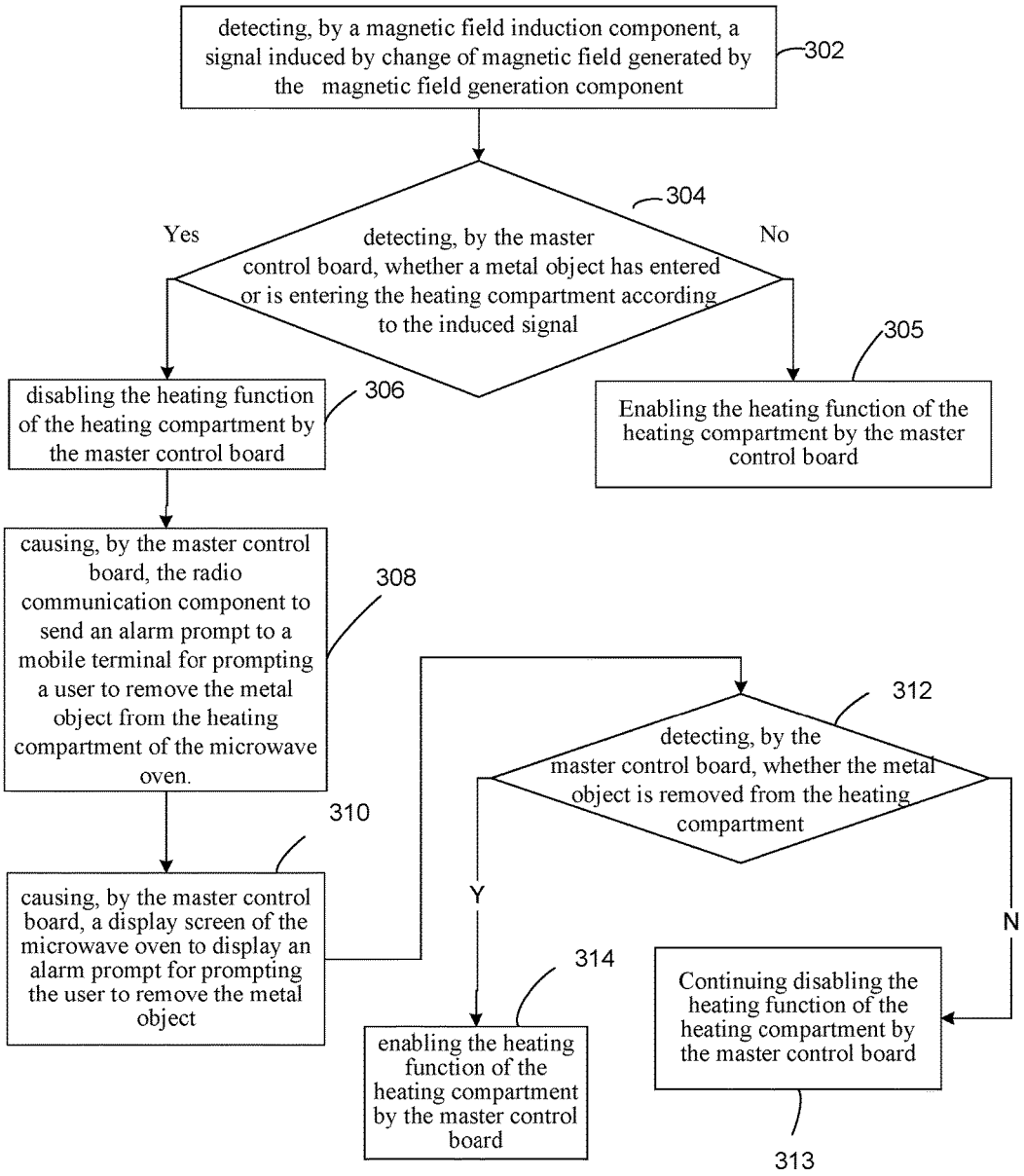
FIG. 8 is a flow chart of yet another safe operation method for a microwave oven.

In some other implementation, as shown in FIG. 8, the method of FIG. 7 may further include Step 312, Step 313 and Step 314. Similarly, the methods of FIG. 3 or FIG. 5 may further include these steps.

In Step 312, the master control board determines whether a metal object is removed from the heating compartment.

In Step 313, when it is determined by the master control board that no metal object has been or is being removed from the heating compartment, the master control board may continue disabling the heating function of the heating compartment of the microwave oven.

In Step 314, when the master control board determines that a metal object has been or is being removed from the heating compartment, the master control board enables the heating function of the heating compartment of the microwave oven.

In one implementation, Step 312 for determining, by the master control board, whether a metal object has been or is being removed from the heating compartment may include detecting by the master control board a status of a reset button on the case body of the microwave oven, shown as 13 in FIG. 1. When the master control board determined that a user has pressed this button since the last time that an entering of a metal object into the heating compartment was detected, the master control board may determine that the metal object has been removed from the heating compartment.

Alternatively, Step 312 for determining, by the master control board, whether a metal object has been or is being removed from the heating compartment includes detecting by the master control board a signal from the magnetic field induction component indicating that a metal object is being removed from the heating compartment. For example, when the metal object is removed from the heating compartment, the movement direction of the metal object at the time of removal is opposite to the movement direction of a metal object entering the heating compartment. The magnetic field induction component, such as a magneto-resistive sensor, may sense an induced signal that is of opposite sign to the signal induced in the magnetic field induction component when a metal object enters the heating compartment. Therefore, the master control board may determine whether a metal object is being entered or being removed from the heating compartment based on the signal detected by the magnetic field induction component. When the master control board determines from the signal detected by the magnetic field induction component that a metal object has been removed from the heating compartment, the master control board may enable the heating function of the heating compartment of the microwave oven such that the microwave may function normally when a user instruction (pressing a start button, for example) is given for starting heating.

Thus, the methods described above for operating a microwave oven improves safety by detecting a metal object when it enters the heating compartment of the microwave oven and disabling the heating function when detecting a metal object entering the heating compartment. By further prompting a user to remove the metal object and enabling the heating function after detecting a removal of the metal object, the normal operation of the microwave is minimally affected.

The illustrations of the embodiments described herein are intended to provide a general understanding of the structure of the various embodiments. The illustrations are not intended to serve as a complete description of all of the elements and features of apparatus and systems that utilize the structures or methods described herein. Other embodiments of the disclosure will be apparent to those skilled in the art from consideration of the specification and practice of the embodiments disclosed herein. This application is intended to cover any variations, uses, or adaptations of the disclosure following the general principles thereof and including such departures from the present disclosure as come within known or customary practice in the art. It is intended that the specification and examples are considered as exemplary only, with a true scope and spirit of the invention being indicated by the following claims in addition to the disclosure.

It will be appreciated that the disclosure is not limited to the exact construction that has been described above and illustrated in the accompanying drawings, and that various modifications and changes can be made without departing from the scope thereof. It is intended that the scope of the disclosure only be limited by the appended claims.

INDUSTRIAL APPLICABILITY

The microwave oven provided in an embodiment of the disclosure includes a case body which includes a heating compartment, a master control board disposed in the case body, a magnetic field generation component and a magnetic field induction component disposed in the heating compartment, wherein the magnetic field induction component is electrically connected with the master control board. The disclosure improves safety in operating a microwave oven.

What is claimed is:

1. A microwave oven, comprising:

a case body comprising a heating compartment;

a master control board disposed in the case body; and a magnetic field generation component and a magnetic field induction component disposed in the heating compartment, wherein the magnetic field generation component generates a magnetic field;

wherein the magnetic field induction component is electrically connected to the master control board;

wherein the magnetic field induction component is configured to output a first induction signal upon detecting a first change in the magnetic field, and output a second induction signal upon detecting a second change in the magnetic field;

wherein the master control board is configured to determine, according to the first induction signal, whether a metal object has entered or is entering the heating compartment, and to disable a heating function of the heating compartment in response to determining that the metal object has entered or is entering the heating compartment;

wherein, when determining whether the metal object has entered or is entering the heating compartment according to the first induction signal, the master control board is further configured to detect that the first induction signal increases or decreases gradually, and to determine that the metal object has entered or is entering the heating compartment;

wherein the master control board is further configured to determine, according to the second induction signal, whether the metal object has been or is being removed from the heating compartment, and to enable the heating function of the heating compartment in response to determining that the metal object has been or is being removed from the heating compartment;

wherein, when determining whether the metal object has been or is being removed from the heating compartment according to the second induction signal, the master control board is further configured to detect that the second induction signal is of an opposite sign to the first induction signal when the metal object enters the heating compartment, and to determine that the metal object has been or is being removed from the heating compartment;

a reset button; and wherein the master control board is configured to:

detect whether the reset button is pressed, in response to detecting that the reset button is pressed, determine that the metal object has been or is being removed from the heating compartment, and enable the heating function of the heating compartment in response to determining that the metal object has been or is being removed from the heating compartment.

2. The microwave oven of claim 1, wherein the magnetic field induction component is disposed at an entrance of the heating compartment.

3. The microwave oven of claim 1, wherein the magnetic field induction component comprises only one magnetic induction sensor.

4. The microwave oven of claim 1, wherein the magnetic field induction component comprises multiple magnetic field induction sensors.

5. The microwave oven of claim 4, wherein when the magnetic field induction component comprises multiple magnetic field induction sensors, the master control board is configured to derive a shape and size of the metal object according to a set of first induction signals detected by the multiple magnetic field induction sensors.

6. The microwave oven of claim 1, wherein the magnetic field induction component is a magneto-resistive sensor.

7. The microwave oven of claim 1, wherein the magnetic field generation component is a permanent magnet.

8. The microwave oven of claim 1, wherein the magnetic field generation component is a magnetic coil connected electrically to the master control board.

9. The microwave oven of claim 1, further comprising a radio communication component connected electrically to the master control board, wherein the radio communication component comprises at least one of a Wireless Fidelity (Wi-Fi) network interface, a Bluetooth interface, and a zigbee interface.

10. The microwave oven of claim 1, further comprising a display screen connected electrically to the master control board.

11. A control method for operating a microwave oven, comprising:

detecting, by a magnetic field induction component disposed at an entrance of a heating compartment of the microwave oven, a first induction signal due to a first change of a magnetic field generated by a magnetic field generation component disposed at the entrance of the heating compartment of the microwave oven;

determining, by a master control board electrically connected to the magnetic field induction component, whether a metal object has entered or is entering the heating compartment according to the first induction signal; and disabling, by the master control board, a heating function of the heating compartment in response to determining that a metal object has entered or is entering the heating compartment;

wherein the determining by the master control board whether the metal object has entered or is entering the heating compartment according to the first induction signal comprises: detecting, by the master control board, that the first induction signal increases or decreases gradually, and determining, by the master control board, that the metal object has entered or is entering the heating compartment;

detecting, by the magnetic field induction component, a second induction signal due to a second change of the magnetic field generated by the magnetic field generation component;

determining, by the master control board, whether the metal object has been or is being removed from the heating compartment according to the second induction signal or according to a reset button; and enabling, by the master control board, the heating function of the heating compartment in response to determining by the master control board that the metal object has been or is being removed from the heating compartment;

wherein the determining by the master control board whether the metal object has been or is being removed from the heating compartment according to the second induction signal comprises: detecting, by the master control board, that the second induction signal is of an opposite sign to the first induction signal when the metal object enters the heating compartment, and determining, by the master control board, that the metal object has been or is being removed from the heating compartment;

wherein the determining by the master control board whether the metal object has been or is being removed from the heating compartment according to the reset button comprises: detecting, by the master control board, whether the reset button is pressed, and in response to detecting that the reset button is pressed, determining, by the master control board, that the metal object has been or is being removed from the heating compartment.

12. The method of claim 11, further comprising:

causing, by the master control board, a radio communication component of the microwave oven connected electrically to the master control board, to send an alarm prompt to a mobile terminal for prompting a user remove the metal object from the heating compartment of the microwave oven, in response to determining by the master control board that a metal object has entered or is entering the heating compartment.

13. The method of claim 11, further comprising:

causing, by the master control board, a display screen of the microwave oven connected electrically to the master control board, to display an alarm prompt for prompting a user to remove the metal object from the heating compartment of the microwave oven, in response to determining by the master control board that a metal object has entered or is entering the heating compartment.

* * * * *